United States Patent [19]

Stirling

[11] 4,234,386

[45] Nov. 18, 1980

[54] CONTINUOUS COKE MAKING

[76] Inventor: Harold T. Stirling, 39 Hoodridge Dr., Mount Lebanon, Pa. 15228

[21] Appl. No.: 22,872

[22] Filed: Mar. 22, 1979

[51] Int. Cl.[3] ..... C10B 47/00; C10B 53/08

[52] U.S. Cl. ..... 201/6; 201/44; 44/10 K

[58] Field of Search ..... 201/6, 21, 23, 44, 5; 44/10 R, 10 C, 10 K; 264/29.1, 29.5, 29.7

[56] References Cited

U.S. PATENT DOCUMENTS

| | | | |
|---|---|---|---|
| 2,556,154 | 6/1951 | Kern | 201/6 |
| 3,316,155 | 4/1967 | Holowaty et al. | 201/6 |
| 3,533,961 | 10/1970 | Voet et al. | 201/6 X |
| 3,546,076 | 12/1970 | Muller et al. | 201/6 |
| 3,663,186 | 5/1972 | Dzhaparidze et al. | 201/6 X |
| 4,039,319 | 8/1977 | Schapiro et al. | 44/10 C X |
| 4,110,169 | 8/1978 | Suzuki et al. | 201/6 |
| 4,134,794 | 1/1979 | Lorenz et al. | 201/44 X |
| 4,141,793 | 2/1979 | Aoki et al. | 201/6 |
| 4,142,941 | 3/1979 | Weber et al. | 201/6 |
| 4,148,692 | 4/1979 | Chu et al. | 201/6 X |

FOREIGN PATENT DOCUMENTS

| | | | |
|---|---|---|---|
| 2755562 | 6/1978 | Fed. Rep. of Germany | 44/10 R |
| 547115 | 8/1942 | United Kingdom | 201/6 |

*Primary Examiner*—Joseph Scovronek
*Assistant Examiner*—Roger F. Phillips
*Attorney, Agent, or Firm*—Ronald S. Cornell

[57] ABSTRACT

Binder is added to any finely divided coal which can be made to coalesce on heating, the particles are formed into any shape desired for its end usage, and pyrolyzed under conditions carefully controlled to limit the rate of temperature rise of the shaped forms.

6 Claims, No Drawings

CONTINUOUS COKE MAKING

BACKGROUND OF THE INVENTION

This invention relates to coked coal and more particularly to the continuous production of coke from any type of coal which can be made to coalesce on heating.

In order to satisfy the ever increasing demand for products made from iron since the beginning of the Iron Age, man has had to seek new sources of iron bearing minerals. However, in order to extract the iron content of these minerals, the ore must be smelted with a reducing agent that will react with the elements that are naturally combined with iron and which maintain the iron in its primordial rock status. Traditionally, this reducing agent has been carbon in its crude or purer form. For centuries the carbon source was wood char—"char coal"—autogenously produced by ignition of the outside of a wood pile where the heat so generated penetrates inward to the exclusion of air and carbonizes the raw wood to a black char which contains in excess of 75% carbon.

However, in order to satisfy the demand caused by the exponential increase in population and the corresponding increase in human demand for iron products, the production of wood char-coal reductant was expanded by using externally heated ovens wherein the wood was charred by heat through the oven walls. The heat was created by burning tree bark and branches in order to make maximum use of the tree wood, both as fuel and as feedstock for the char-coal.

As the demand for iron products continued to increase, the availability of trees to be carbonized to the reducing "wood char" needed by the smelter became inadequate. Char-coal production then evolved into a method utilizing "coke ovens".

The first "coke ovens" were of the "traditional" beehive design wherein coal was charged to a bee-hive-shaped ceramic structure that could be heated externally by the combustion of coal beneath this ceramic crucible and driving off the hydrogen and oxygen contained in the coal to produce a residue with less than 1% of the matter, contained in the coal, that would crack and distill at temperatures in excess of 2000° F. (1100° C.).

Because of the waste of heat in terms of coal substance lost (from 15% to 50%) a technology was developed that recovered the substances driven off by the pyrolysis. This development was called the "by product" or "slot-type" oven and has dominated the production of a carbon reductant and heat source from coal for the iron and steel industry to the practical exclusion of any other technique.

A reductant made from coal that is designed for use with a modern, high-wind velocity, blast furnace must meet very definite physical and chemical specifications. On the chemical side of the specifications, solid reductants destined for blast furnace use are specified to contain less than 3 wt.% volatile matter on a dry basis when tested via the ASTM method D-271-70.

In addition are implied specifications which require that the volatile matter contained in any reductant used in a blast furnace—regardless of quantity—contain no substance that will produce a "tar" on condensation. While the ash and sulphur content of the reductant are vital from the standpoint of efficiency and statutory requirements, these properties are controlled by the amount of these elements permitted in the raw coal feed. The main chemical control of iron ore reductants from coal remains the volatile content of the "coke" product.

On the physical side of the specifications for such reductants are the strength characteristics of resistance to destruction by abrasion and the resistance to destruction by sudden impact. There are a number of ASTM tests used to measure those qualities. But the most important of those qualities is the ability of the reductant (coke) to withstand the tumbling and dropping action without breaking down into pieces of less that ¼ inch (6.4 mm) in volume dimensions. To the extent that such break-ups occur, to that same extent, on some relative basis, will the productive capacity of any given furnace be reduced. This quality can only be inferred from the aforementioned tests. Actual use in, and observation of, a given furnace response to a specific solid reductant is the final test.

In order to produce the chemical and physical qualities required, the formulation of a charge to a by-product or bee-hive oven must be controlled. A minimum of about 25% of certain low volatiles matter coals—15% to 25% volatile matter content—must be maintained. "Blending" coals must also have properties that will enhance coke quality. Originally, the United States supply of the low volatile metallurgical coal (although essentially limited to Pennsylvania, West Virginia, Ohio and Alabama) seemed inexhaustible. However, since World War II the demand for iron products has increased not only exponentially to match population growth, but as well by the back log requirements of developing nations and the increase in the material quality of life styles in Western Culture. This explosion in the use of iron has caused a continuing serious depletion in the supplies of metallurgical quality coals, i.e. those coals that can be used in by-products ovens to produce coke which will meet blast furnace specifications as well as fuel for foundry operations.

Many attempts have been made to develop a method that would use almost all the world coal supplies to produce solid metallurgical reductant. A few have been experimentally successful, but only one is of commercial status at the present time. All of these processes included reduction of the coal to sizes less than 3/16 of an inch (4.76 mm) and recombination of those particles, after partial or complete pyrolytic devolatilization, by forming with binder followed by a subsequent pyrolytic devolatilization to reduce the volatile matter and/or eliminate the tars that may form in high temperature applications. No process has successfully used, to advantage, one fundamental property of all coal—the development of an adhesive state in the temperature history during pyrolytic devolatilization.

The most nearly commercial operation grinds the delivered coal to minus 3/16" (4.76 mm), devolatilizes this ground coal via fluidized bed pyrolysis techniques, produces a tar and a char, devolatilized to less than 3% as measured by ASTM method D-271-70, combines the tar and char in a briquetting operation to any desired size and subsequently devolatilizes the final shape in two temperature stages—a low temperature stage using air and a high temperature stage using flue gas—to less than a 3% volatile matter, i.e. strong coke for use in metallurgical processes. This process does not require a specific rank of coal.

Another known process grinds coal to a size amenable to charring in particulate form; the devolatilized char, produced in a recycling transport reactor, yields tar and a carbonization aqueous liquor. The char is heated at or near the softening point of raw coal which is combined with the char and tar in a briquetting operation whereby the heat from the char and the heat developed by pressure briquetting act to soften the scarce coking or binder coal into the raw shapes; these resulting briquettes are devolatilized in a slow heating cycle, in the presence of some air, to less than a 3% volatile matter product. This process requires between 20% and 30% of a high quality metallurgical coal as the binder coal.

Yet another known process, essentially the same as that described immediately above uses hot pelletizing instead of briquetting. This process essentially requires a coal blend similar to the blends fed to "by-product" ovens. The advantage of this process lies in its continuous operation as opposed to the batch sequence used in the "by-product" oven.

Finally, still in pilot stage, is a process wherein dried coal is heated to about 400° F. (204° C.) blended with a tar recovered from devolatilization and formed into a desired shape; the shape is devolatilized by heating with an oxygen-free flue gas which flows upward through a downward flow of solid shapes. At some point, air is introduced to the shaft in order to combust some of the coal and coal gasses to supply heat for devolatilization.

The process of the present invention, described in more detail below, differs from the foregoing processes in that it makes use of the adhesive properties of the coal substance by a carefully controlled heating, in the absence of air, of the shapes which have been formed by mixing ground, raw coal (5% water maximum) with binder inherent or foreign to the process. This heating regimen is carefully matched to the devolatilization rate of the coal with respect to temperature. By doing so, instead of permitting the shapes to melt and/or agglomerate to a weak useless mass, the single process involving melting and agglomeration gives the final product the necessary strength and only requires commonly available, safe equipment.

The process of this invention can utilize any coal that distills off tar-forming substances at any point in the coal's devolatilizing history. The process of this invention differs from the first mentioned prior known process in that no devolatilization prior to forming is used and devolatilization continues uninterruptedly to the finished product. The process of this invention differs from the second and third aforementioned processes in that forming does avoid use of a charred product and of all of the attendant dangers of exposing to oxygen the coal product solids that are at or above the autoignition temperature of the solid product. The process of this invention also has the advantage that it does not require more than one coal feed, although a blend of a multiple of feeds can be used.

The process of this invention differs from last abovementioned processes in that at no point in the heating cycle is air introduced into the system. Accordingly, the dangers that accompany the introduction of oxygen to a combustible material above the point of its autoignition and/or explosive ignition are eliminated. Also, the process of this invention, unlike the earlier process, does not require any special blend of coals.

DETAILED DESCRIPTION OF THE INVENTION

In carrying out the process of this invention, raw coal is ground to particles having a size generally less than ¼ of an inch and their water content is reduced, for example to 5% in any standard drying and grinding operation, either simultaneously or, alternately, the coal may be separately ground and then dried in a manner known in the art using equipment presently available on the open market. The ground coal of adjusted water content is then mixed with a binder which preferably is the tar recovered from the coal's subsequent devolatilization, but may be any hydrocarbonaceous liquid that can be devolatilized to a carbon residue, e.g. topped coke over tar, asphaltic petroleum residues, various systems or residues from sugar refining, organic polymers or organic monomers which have the property of polymerizing and pyrolyzing to coke without loss of strength of the bonds produced by forming.

This mixing is carried out at the lowest possible temperature, which, however, must be sufficiently high to give the binder a low enough viscosity to assure uniform mixing in a short period of time. The temperature will depend on the flow characteristics of the specific binder used, and the mixing time for any binder should not have to exceed 10 minutes.

The green mix is fed to a forming device preferably, but not limited to, a roll briquetting press wherein standard commercial practice is used to produce shapes of any desired size up to a pillow block of 12"×6"×6" in over-all dimensions. The techniques of commercial briquetting or extrusion indicated that larger shapes can be made if desired.

A highly important aspect of the process of this invention lay in the manner in which the high volatile content of these green shapes, which contain all of the original coal's volatile matter plus the volatile matter of the binder, is reduced to less than 2% without destroying the shape and yet producing a strong, homogenous piece of solid reductant that will withstand the rigors of blast furnaces or cupola reactions without degrading to fines which would be carried out of the equipment to the atmosphere.

The removal of this volatile component is accomplished by programmed heating, preferably in a device that does not permit movement of one briquet relative to another so that the integrity of the formed shape is maintained through the critical temperature period when all coals soften or melt to a greater or lesser degree and cause deforming in shapes by softening of the volatilizing coal. This is accomplished by a carefully controlled heating regimen. The process described herein can be successfully applied to coals that vary from "Low-Volatile Bituminous" (15% min VM) to "High Volatile Lignites" in rank. The raw formed shapes used to develop these data contained 10% by weight of a roofing pitch procured from commercial sources and more fully described in the stated examples. The forming method used a standard roll briquetting machine.

In order to illustrate the nature of the invention the following describes the heating regimen that should be practiced in order to obtain the benefits thereof.

Coal-pitch briquettes are fed to a rotating hearth furnace, the briquettes are piled 10 to 24 inches in depth, and heated up to 250° F. at 10° F. per minute or 25 minutes; and they are held at 250° F. for 30 minutes to complete the removal of water. The next phase in the heating regimen is the preliminary gas evolution from, and shrinkage of, the coal and pitch binder. With all coals, but in particular with the low and medium volatile coals (15% to 33% VM) a melting and/or agglomeration normally occurs as the coal passes through a temperature zone from about 500° to 1000° F. It has been found by others that when briquettes made from raw coal and binder were heated without regard to the heat rate—allowing the temperature rise to be controlled by the heat transfer coefficient alone—that the briquettes so made and treated perform as does the raw coal from which they were made.

When the raw dried briquettes, made in accordance with the present invention are heated through a critical temperature (broadly from 250° to 1250° F., but generally from 650° to 1150° F.) at a rate controlled to maintain the temperature rise at 5° F. per minute, the briquettes are evenly shrunk and the gases evolved contain a maximum amount of tar. Unexpectedly, the briquettes show no serious evidence of melting, and on continued heating in an atmosphere inert to carbon reactions at rates of 10° and 20° F. per minute up to 2200° F., very strong, homogenous and structurally sound briquettes of about 75% of original volume of the raw briquettes are produced.

During this processing the heating from about 250° F. to 650° F. can be carried out at a rate of about 10° F. per minute, and from about 650° F. to 1150° F. the rate is reduced to about 5° F. per minute. Above about 1150° F., the rate can safely be increased to about 10° F. per minute to about 1450° F.; and a 20° F. rate can be used thereafter up to about 2050° F., the final devolatilizing temperature. Cooling to a temperature of 250° F. is accompanied by any suitable method such as by contact with a cool gas which causes the temperature to drop 1800° F. in 10 minutes without deleterious effects on the devolatilized coke shapes.

The unique discovery deduced from this data is that in the area of the temperature from that point at which the coal begins to give off gases through the temperature range where these gases appear to be in maximum quantity and contain a maximum amount of tar-forming components when cooled, the rate at which coal substance is lost by pyrolysis—devolatilization—increases by some exponent. As a result, the coal structure is normally destroyed; the devolatilizing coal may either melt and coalesce and agglomerate to form a mass of residue (coke) or the individual pieces, regardless of their size, may explode into a honeycomb of residue that is weak and friable to the touch and is useless as a metallurgical reductant.

It has been found that the rate of devolatilization, as determined by graphic differentiation, varies with the temperature at any point. The average of these variations may be divided into four distinct areas. The first stage, from ambient temperature to approximately 650° F., is a water vaporization and heat condition period wherein the weight loss (devolatilization rate) reaches 0.03 percentage points per degree Fahrenheit. However, while the curve advances as an approximately straight line with temperature in this range, there is a point of inflection between 500° and 650° F. This is the beginning of the second stage, where the loss in weight—the rate of volatile expulsion—changes radically by at least one order of magnitude to 0.35 percentage points per degree Fahrenheit. This explosive rate continues to a second point of inflection between approximately 900° F. to 1500° F., the beginning of the third stage. Through the second point of inflection to the beginning of the third stage at about 1500° F. the rate of volatile matter expulsion falls back to 0.05 percentage points per degree Fahrenheit. After this temperature area is passed the devolatilization rate remains constant at 0.02 percentage points per degree Fahrenheit.

By controlling the rate of volatile matter expulsion to a maximum of 0.06 percentage points per degree Fahrenheit, the melting, coalescing and devolatilization that occurs with agglomerating coals and the destructive explosive expansion that occurs with non-agglomerating coals can be minimized and the adhesive properties attending these occurrences can be used to strengthen the bound pieces that constitute the product of this invention.

It was found that the heating regimen curve could be applied to those bituminous coals of commercial significance, that the relationship for any individual coal was an approximate mirror image of the curve that may be drawn by plotting the volatile matter vs. the final temperature to which the coal sample was heated. This curve, which can be identified as the "VM vs. Temperature Plot" gives the rate of heating required to achieve these unexpected results by obtaining a constant rate of devolatilization at any point on the curve. The reciprocal of that rate of devolatilization converted to temperatures in any given segment of the curve is the maximum permitted degrees increase in temperature to achieve the phenomenon described. Lower heating rates will, of course, achieve the same results in longer time. However, the upper limit is as stated. Upward variation from this maximum limit by more than about 10% will cause an agglomeration in the case of coals that agglomerate and/or melt, and degradation in case of those subbituminous coals that do not exhibit any agglomeration properties. The VM-vs.-temperature curve was developed by following the ASTM method, D-271-70, but carrying out the test to the temperature indicated in the abcissa; the resulting loss of volatile matter is plotted against the ordinate as a percentage of the total volatile matter determined at 2000° F.

The necessary heating regimen may be carried out by indirect conduction of heat through the wall of a heated vessel, by radiant heat transferred from the walls or gases above the bed of briquettes or, preferably, by direct contact with hot gases controlled at a temperature required to produce the desired temperature in the briquette mass. Inert atmosphere should be maintained in which less than about 4%, preferably 2%, oxygen is present at any time during the heating cycle. Steam and carbon dioxide may be used at temperatures below 1200° F. Above 1200° F. these gases should be avoided in order to prevent gasification and loss of carbon reductant values to their carbon oxide counterparts. The cooling gas should also contain less than about 2% oxygen and that amount of water vapor that can be held in the gases when they are cooled down for recycling to remove the heat from the final briquette.

The total time under heat will generally vary from 3 to 6 hours depending on the rate predetermined for each individual coal as hereinbefore described.

EXAMPLES

The following examples illustrate the practice of this invention. These examples are not intended to limit the invention in any respect.

EXAMPLE I—MEDIUM VOLATILE BITUMINOUS COAL

Ninety-five pounds of an Illinois No. 6 coal, dried to 5% total moisture, were mixed for 5 minutes at 200° F. with 10% of "roofing pitch" with a softening point of 140° F. Ring and Ball VIA ASTM D-36-11, 0 wt.% naphthalene and 5 wt.% of matter insoluble in 1° quinoline. Mixing was done in a standard pug mill, and the mix was then fed to a roll briquette press to produce briquettes of 2"×2"×1¼" dimensions. These raw briquettes were heated in a radiant type muffle furnace in the absence of oxygen through the heating regimen described above. After completion of the heating to about 2100° F., the hot devolatilized briquettes were cooled by blowing cold dry nitrogen through the entire mass until the temperature of the individual briquettes were reduced to below 250° F. When cooled to room temperature, these briquettes tested as follows:

| RESISTANCE TO ABRASION; ASTM D-294-(wt %) | |
|---|---|
| Stability Index | 72.0 |
| Hardness Index | 0.0 |
| PROXIMATE ANALYSIS; ASTM D-271-(wt %, dry) | |
| Volatile Matter | 1.0 |
| Ash | 9.0 |
| Fixed Carbon | 90.0 |
| REDUCTANT YIELD-(wt. % of coal) | 67.0 |

EXAMPLE II—SUB-BITUMINOUS HIGH VOLATILE "C" COAL

Ninety-five pounds of a Wyoming Coal, dried to contain 5% total moisture, were mixed, in the equipment used in Example I, with 10 pounds of pitch from the stock used in Example I under the same conditions. These raw briquettes were devolatilized by heating on a program as used in Example I, but increasing the rate by 25% to 2100° F. After cooling as in Example I, these briquettes tested as follows:

| RESISTANCE TO ABRASION; ASTM D-294-(wt %) | |
|---|---|
| Stability Index | 63.0 |
| Hardness Index | 0.0 |
| PROXIMATE ANALYSIS; ASTM D-271-(wt %, dry) | |
| Volatile Matter | 1.5 |
| Ash | 6.0 |
| Fixed Carbon | 93.5 |
| REDUCTANT YIELD (wt % of dry coal) | 60.0 |

EXAMPLE III—LOW VOLATILE BITUMINOUS COAL

Ninety-three pounds of Pocahontas coal from the southern part of West Virginia, containing 3% water, were mixed with 10 pounds of roofing pitch and briquetted as in Example I. These raw briquettes were treated by heating in a regimen that caused the temperature to rise at a rate that was 70% of the rate described in the heating regimen between 650° F. and 1200° F. The other portions of the heat treatment were the same as in Example I. The resulting reductant briquettes were 75% of the volume of the raw briquettes. These briquettes were heated in a continuous process by passing them on a continuous enclosed grate of known construction through inert gas maintained at the required temperature, about 5° F. above the temperature to which the briquettes were to be heated in any zone and using 3 zones in the critical range of 650° F. to 1150° F., in order to duplicate the batch operations of Examples I and II. In the final stage the briquettes were raised to 2100° F. by heating with combustion gas entering the bed at 2200° F. Heating in the critical zone the rate was controlled so that the temperature rise did not exceed 3° F. per minute, and in the non-critical zone above 1200° F., the rate depended only on the heat transfer coefficient of the hot gas at 3 feet per second passing over the carbon surface and the penetration of the heat from the hot gas to the briquette center. A total of 5 minutes was required to reach the 2100° F. maximum temperature. On cooling with inert gas, these briquettes tested as follows:

| RESISTANCE TO ABRASION; ASTM D-294-(wt %) | |
|---|---|
| Stability Index | 85.0 |
| Hardness Index | 0.0 |
| PROXIMATE ANALYSIS (wt %, dry) | |
| Volatile Matter | 0.5 |
| Ash | 6.0 |
| Fixed Carbon | 93.5 |
| REDUCTANT YIELD (wt % of dry coal) | 81.0 |

It is apparent that these examples illustrate that this invention can successfully be applied to the three coals shown which span the rank scale from low volatile bituminous to high volatile sub-bituminous coal. It appears that lignite could also be so treated.

What is claimed is:

1. A method of preparing metallurgical reductants from coal comprising the steps of mixing a feed consisting essentially of an organic binder and one dry particulate coal capable of coalescing upon heating, compacting the resulting mixture into shaped forms, and heat-treating the shaped forms in a sequential temperature increasing regimen that limits the volatile matter expulsion to a maximum of 0.05 percent per minute while raising the temperature at a rate of less than 10° F. per minute during that period of time at which the coal is at a temperature at which there is a tendency for the coal to soften.

2. A method for preparing metallurgical reductants as described in claim 1 where the binder is a pitch derived from the distillation and blowing of coke oven tar.

3. A method for preparing metallurgical reductants as described in claim 1 where the binder is a tar or pitch derived from processing the shaped forms.

4. A method for preparing metallurgical reductants as described in claim 1 where the binder is an organic polymer, an organic monomer that polymerizes on heating, or a sugars or sugar product.

5. The method of claim 1 wherein the temperature during the said period is increased at a rate not exceeding about 5° F. per minute.

6. The method of claim 1 wherein the rate to limit the volatile matter expulsion to a maximum of 0.05 percentage points per minute, is determined on the basis of the volatile content of the untreated formed shape being 100% as determined by the method of the ASTM No. D-271-70 or its equivalent D-3175-73.

* * * * *